US007414211B2

(12) United States Patent
Elsworthy

(10) Patent No.: US 7,414,211 B2
(45) Date of Patent: Aug. 19, 2008

(54) MODULAR POWER HAND TOOL

(75) Inventor: Christopher Thomas Elsworthy, Bristol (GB)

(73) Assignee: C Enterprise (HK) Limited, Kowloon (HK)

( * ) Notice: Subject to any disclaimer, the term of this patent is extended or adjusted under 35 U.S.C. 154(b) by 34 days.

(21) Appl. No.: 11/543,103

(22) Filed: Oct. 5, 2006

(65) Prior Publication Data

US 2008/0083601 A1 Apr. 10, 2008

(51) Int. Cl.
*H01H 9/06* (2006.01)

(52) U.S. Cl. ..... 200/332.2; 200/1 V

(58) Field of Classification Search ..... 200/1 V, 200/16 B, 16 R, 522, 332.2
See application file for complete search history.

(56) References Cited

U.S. PATENT DOCUMENTS

| | | | | |
|---|---|---|---|---|
| 4,342,931 | A * | 8/1982 | Grossmann et al. | 310/50 |
| 5,089,729 | A * | 2/1992 | Moores, Jr. | 310/50 |
| 6,181,032 | B1 | 1/2001 | Marshall et al. | |
| 6,656,626 | B1 * | 12/2003 | Mooty et al. | 429/99 |
| 6,749,028 | B1 * | 6/2004 | Chan et al. | 173/170 |
| 7,038,154 | B2 * | 5/2006 | Höfte et al. | 200/332 |

FOREIGN PATENT DOCUMENTS

DE 4342931 C1 * 7/1995

* cited by examiner

*Primary Examiner*—Michael A Friedhofer
*Assistant Examiner*—Lisa N Klaus
(74) *Attorney, Agent, or Firm*—Leydig, Voit & Mayer, Ltd.

(57) ABSTRACT

A power handle module encloses rechargeable batteries which can be used to power a number of modular special-purpose tools which may be mounted to the power handle module. The power handle module includes a hand grip, a trigger switch operated by a trigger and a first connector for engagement with a second connector on the special-purpose tool. An interlock operator on the handle module may be moved between a guard position where it resists pressure to move the trigger and at least one armed position, in which position it allows the trigger to be pressed. A secondary switch is mounted within the power handle module. When the special-purpose tool is a fastener driver the secondary switch controls direction of rotation of the motor on the tool. The fastener-driving tool includes a link for mechanically joining the secondary switch and the interlock operator upon connection of the first and second connectors such that by moving the interlock operator between the first and second armed positions the secondary switch is moved between switch positions. When the special-purpose tool is a saw the secondary switch provides a safety interlock switch preventing inadvertent rotation of the motor on the tool. The saw tool includes an engagement face that engages the secondary switch upon connection of the first and second connectors to move the secondary switch to one of the switch positions and resilient means for biasing the interlock operator to the guard position.

18 Claims, 6 Drawing Sheets

MODULAR POWER HAND TOOL

TECHNICAL FIELD

The present invention relates to multi-purpose power hand tools, and particularly to modular tools having power handle modules for controlling power input to any one of a number of different special-purpose tools.

BACKGROUND OF THE INVENTION

Multi-purpose power hand tools provide a variety of capabilities for the user, including sawing, drilling, and driving threaded fasteners among others. One class of prior art multi-purpose power hand tool includes a universal drive or power module for supplying shaft power to special-purpose accessories such as rotary cutters which are mounted to the power module. The reconfiguration achieved by mounting different accessories to the output shaft of the power module in this way provides all the advantages of a special-purpose tool without the associated cost, as the tools are able to share a common power supply, controls and motor.

Cordless power tool systems including releasably attachable common battery units selectively attachable to each of a range of tools are well known in the art. Each tool incorporates its own motor and accessories such as rotary blades or chucks. Incorporating a common battery unit makes the complete system more economical since battery packs are relatively high cost components. Various simple sliding couplings are used for electrically and mechanically coupling a battery pack with the tool housing, allowing the batteries to be readily installed and removed.

U.S. Pat. No. 6,181,032 describes a modular, cordless electric tool system with a power handle module to which different special-purpose tools may be fitted. The motors, or the like, of the special-purpose tools are controlled by a trigger on the power handle module. A finger-releasable latch is provided on the power handle module for mechanically fastening it to the special-purpose tool. This latch is interlocked with the trigger to avoid powering the special-purpose tool when connecting it to the power handle module. An actuator connected to the trigger extends through the interface between the two components to engage a switch in the special-purpose tool.

One of the drawbacks associated with all the above-mentioned multi-purpose power hand tools and cordless power tool systems is associated with the controls or switches required for operating them. None of these prior art devices teaches a modular hand tool system able to provide the desired safety and functional features which would allow a universal power handle module to power and control a saw and a reversible power tool. For instance, on power saws, in order to prevent accidental actuation of the motor, a safety switch is typically releasably interlocked with the trigger switch, so that both the safety and trigger switches must be simultaneously actuated to operate the saw blade. In many prior art saws, the safety switch is a button-type switch mounted on a side of the handle. In order to operate the saw, the handle must be gripped, and the user then simultaneously depresses the button-like safety switch with the thumb while squeezing the trigger with one or more of the other fingers of the same hand.

A functional necessity for multi-purpose tools is the ability to provide a control appropriate to the specific operational characteristics required for the tool. Providing a reversible power tool for driving threaded fasteners requires a direction switch to allow the user to select the direction of rotation before squeezing the trigger to rotate the chuck. For special-purpose tools such as fastener drivers, modulating-type control for allowing control of the motor speed is desirable while for circular saws or lamps it would be preferable to have on-off type control.

It is an object of the present invention to overcome or substantially ameliorate at least one of the above disadvantages or more generally to provide an improved multi-purpose power hand tool.

DISCLOSURE OF THE INVENTION

According to one aspect of the present invention there is provided a modular electric tool system comprising:

a power handle module having a housing, the housing having an elongate portion configured to provide a hand grip;

a trigger switch mounted within the casing for actuation by a trigger, the trigger projecting from the housing for use by a user having his hand in place on the hand grip;

an interlock operator projecting from the housing for movement between a guard position and at least one armed position, in the guard position the interlock operator resisting pressure to move the trigger, each the armed position allowing the trigger to be pressed;

a first connector for engagement with a second connector of a special-purpose tool, the first connector being provided with a plurality of electrical contacts;

power supply means, and a circuit internally of the casing electrically connecting the contacts, trigger switch and power supply means.

In this manner the special-purpose tool is connected mechanically to the power handle module and electrically connected to the batteries and the trigger switch when the power handle and the special-purpose tool are engaged. Preferably the power supply means comprises a plurality of battery cells enclosed within the housing.

The power handle module preferably further includes a secondary switch mounted within the casing and movable between respective switch positions, the armed positions of the interlock operator including first and second armed positions, the special-purpose tool comprising either:

a link for mechanically joining the secondary switch and the interlock operator upon connection of the first and second connectors such that by moving the interlock operator between the first and second armed positions the secondary switch is moved between switch positions, whereby the interlock operator is used to select power supply to a device of the special-purpose tool, or an engagement face engaging the secondary switch upon connection of the first and second connectors to move the secondary switch to one of the switch positions and resilient means for biasing the interlock operator to the guard position whereby the interlock operator thereby provides a safety switch.

In one preferred embodiment the power handle module includes a secondary switch mounted within the casing and movable between respective switch positions, the armed positions of the interlock operator including first and second armed positions, the special-purpose tool comprising:

an electric motor drivingly connected to a chuck, and a link for mechanically joining the secondary switch and the interlock operator upon connection of the first and second connectors such that by moving the interlock operator between the first and second armed positions the secondary switch is moved between switch positions, whereby the interlock operator is used to select the direction of rotation of the electric motor.

In another preferred embodiment the power handle module includes a secondary switch mounted within the casing and movable between respective switch positions, the armed positions of the interlock operator including first and second armed positions, the special-purpose tool comprising:

an electric motor for rotating a saw blade, and an engagement face engaging the secondary switch upon connection of the first and second connectors to move the secondary switch to one of the switch positions to select the direction of rotation of the electric motor and resilient means for biasing the interlock operator to the guard position whereby the interlock operator thereby provides a safety switch.

The first and second connectors preferably comprise complementary female and male connectors provided respectively on the power handle and on the special-purpose tool permitting sliding interengagement and disengagement, the male connector having electrical contact means exposed thereon for interengagement with the electrical contacts on the power handle, the male component having a pilot region for engaging a pilot surface on the power handle, the secondary switch having a limb by which it is actuated, the limb protruding from the pilot surface, the interlock actuator including a nub protruding from the pilot surface wherein either:

the link includes a channel which slidably receives both the limb and arm upon connection of the male and female connectors, or the engagement face is provided in a nub-receiving channel in the pilot region for slidably receiving the nub, the engagement face extending obliquely to an axis of relative sliding movement between the male and female connectors.

The resilient means preferably includes a pivoting member having a pivoting member channel for slidably receiving the limb, and a spring biasing the pivoting member channel into linear alignment with the nub-receiving channel.

The first and second connectors are preferably joined at an interface, the interlock actuator including a protruding portion extending through a portion of the interface for engaging the special-purpose tool. The protruding portion is a nub in the preferred embodiment but is not limited to that form. The protruding portion is completely recessed within the housing, thereby protecting it from damage. On some special-purpose tools this protruding portion can be used to engage a switch or a valve on the special-purpose tool. For instance, where the special-purpose tool is a torch the protruding portion may engage a switch for controlling one or more lamps. Where the special purpose tool is a vacuum cleaner the protruding portion may engage a bleed valve.

Preferably the trigger switch has a modulating mode and an on/off mode, a changeover switch is connected to the trigger switch for controlling selection of one of the modulating or on/off modes, and actuating means connected to the changeover switch for engaging a feature of the special-purpose upon connection of the first and second connectors. The first and second connectors are preferably joined at an interface and the actuating means has a part biased to protrude through a portion of the interface for engaging the feature.

BRIEF DESCRIPTION OF THE DRAWINGS

Preferred forms of the present invention will now be described by way of example with reference to the accompanying drawings, wherein.

DESCRIPTION OF THE PREFERRED EMBODIMENTS

Figure 1:
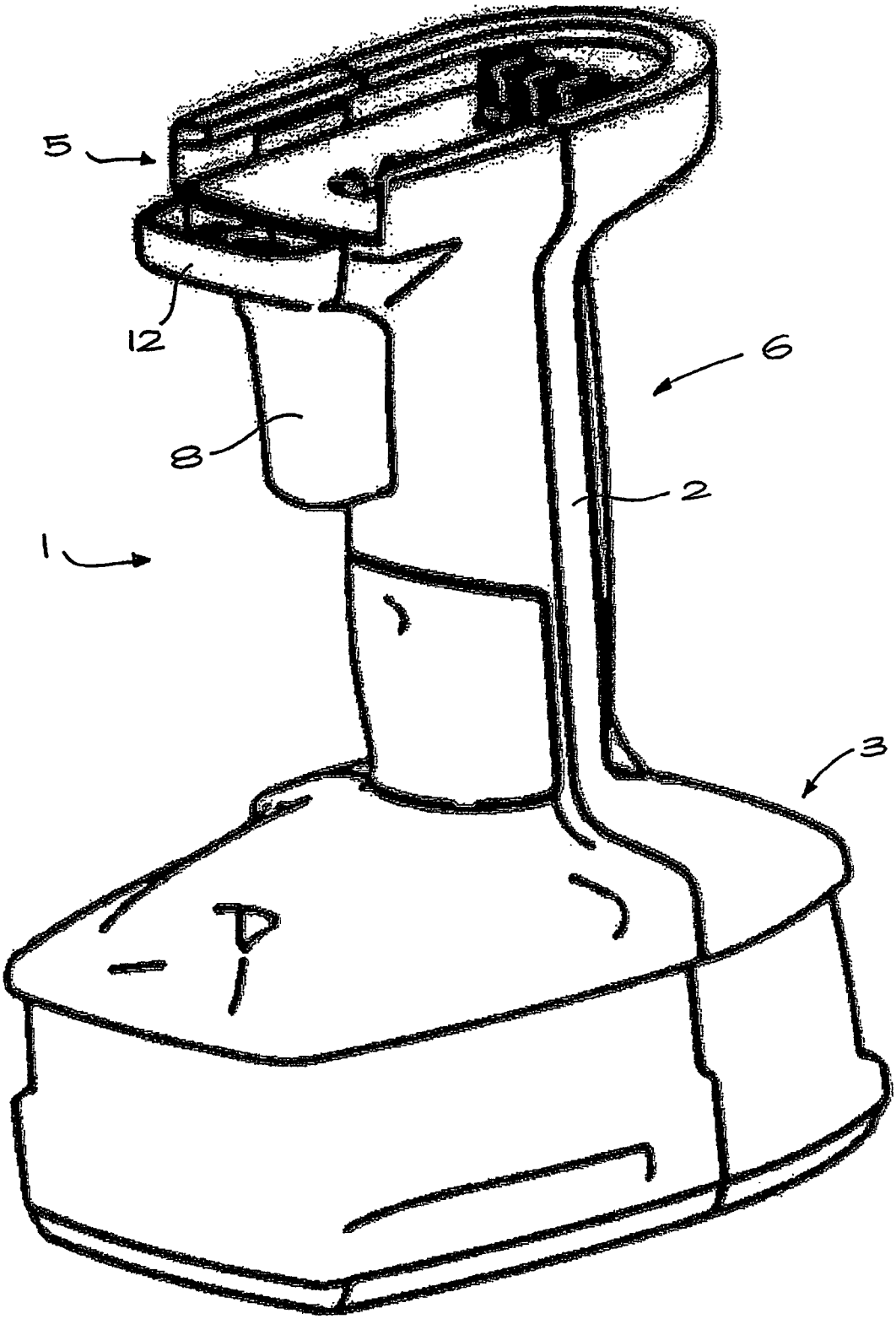
FIG. 1 is a pictorial view of a power handle module of the present invention.
Figure 2:
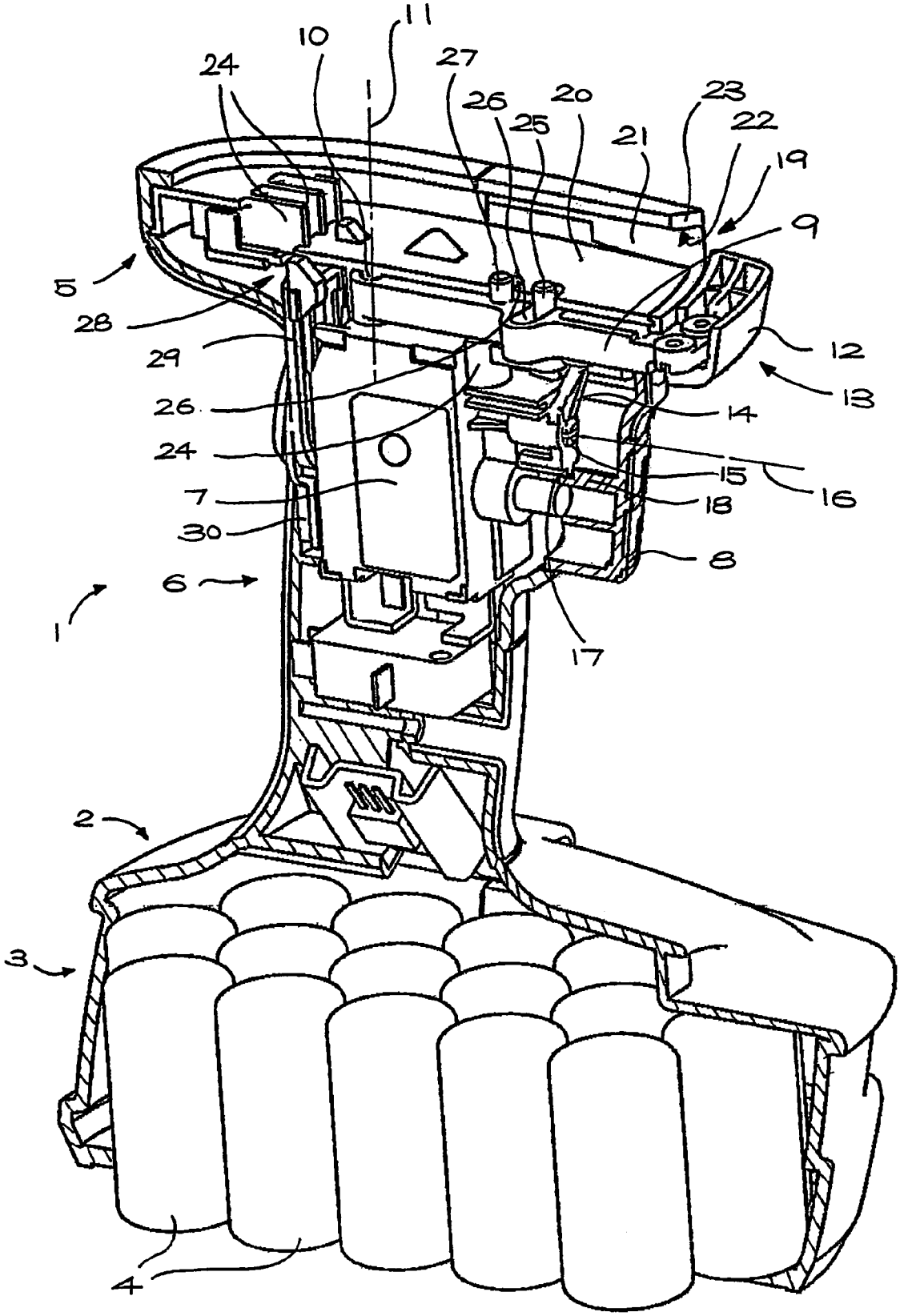
FIG. 2 is a part-sectional pictorial view of the power handle module of FIG. 1.

Referring to FIGS. 1 and 2 a power handle module 1 of a cordless electric tool system includes a housing 2 moulded from a polymeric resin and having a bulbous base 3 enclosing rechargeable battery cells 4. Between the base 3 and an upper female connector 5 or first connector portion, the housing 2 further includes an elongate hollow hand grip 6. Within the upper end of the hand grip 6 a trigger switch 7 of is mounted. The trigger switch 7 is operated by a trigger 8 projecting from the housing for use by a user having his hand in place on the hand grip 6. The trigger 8 is mounted for sliding movement in and out of the hand grip 6 in a direction generally perpendicular to the long axis of the hand grip 6.

An interlock operator 13 includes a bar 9 positioned between the trigger switch 7 and the female connector 5 and mounted by pivot 10 at one end thereof to pivot about an axis 11 generally parallel to the long axis of the hand grip 6. A button 12 at the other end of the bar 9 projects from the housing for actuation by the user. The interlock operator 13 further includes a rocker 14 substantially received within a recess in the trigger 8 and connected by a ball end (not shown) at its upper end to the bar 9. The rocker 14 is mounted in journal 15 to rotate about a transverse axis 16, such that reciprocating movement of the button 12 causes reciprocation of the rocker 14. Adjacent the lower end 17 of the rocker 14 a rib 18 formed within the trigger 8 extends generally parallel to the transverse axis 16.

The interlock operator 13, when appropriately positioned, can prevent movement of the trigger 8 sufficient to operate the trigger switch 7. In this so-called guard position, as shown in FIG. 2, the button 12 is in a central position and the lower end 17 of the rocker 14 abuts the end of the rib 18, thus resisting pressure to move the trigger 8. Moving the button 12 to either side of the central position (to one of two so-called armed positions) displaces the lower end 17 of the rocker 14 to the opposite side of the rib 18. This action "arms" the trigger switch 7 allowing operation of the trigger 8.

The female connector 5 includes a recess having an open end 19 proximate the button 12, and bounded by a planar pilot surface 20 extending transversely, opposing side walls 21 and inner faces 22 of a lip 23 which extends about the recess. At the closed end of the recess, opposite the opening 19, are electrical contacts 54.

A secondary switch 24 (of the double pole, double throw type, for instance) is mounted below the bar 9. The secondary switch 24 is actuated by a limb 25 which extends through an opening 26 in the bar 9 and the pilot surface 20 to protrude from the pilot surface 20. Adjacent the limb 25 a nub 27 fixed to the bar 9 protrudes through an aperture 26 in the pilot surface 20.

A latch 28 mounted in the hand grip 6 opposite the trigger 8 includes a thumb release button 29. Conductors 30 internally of housing 2 electrically connect the contacts 54, trigger switch 7, secondary switch 24 and battery cells 4.

Figure 3A:
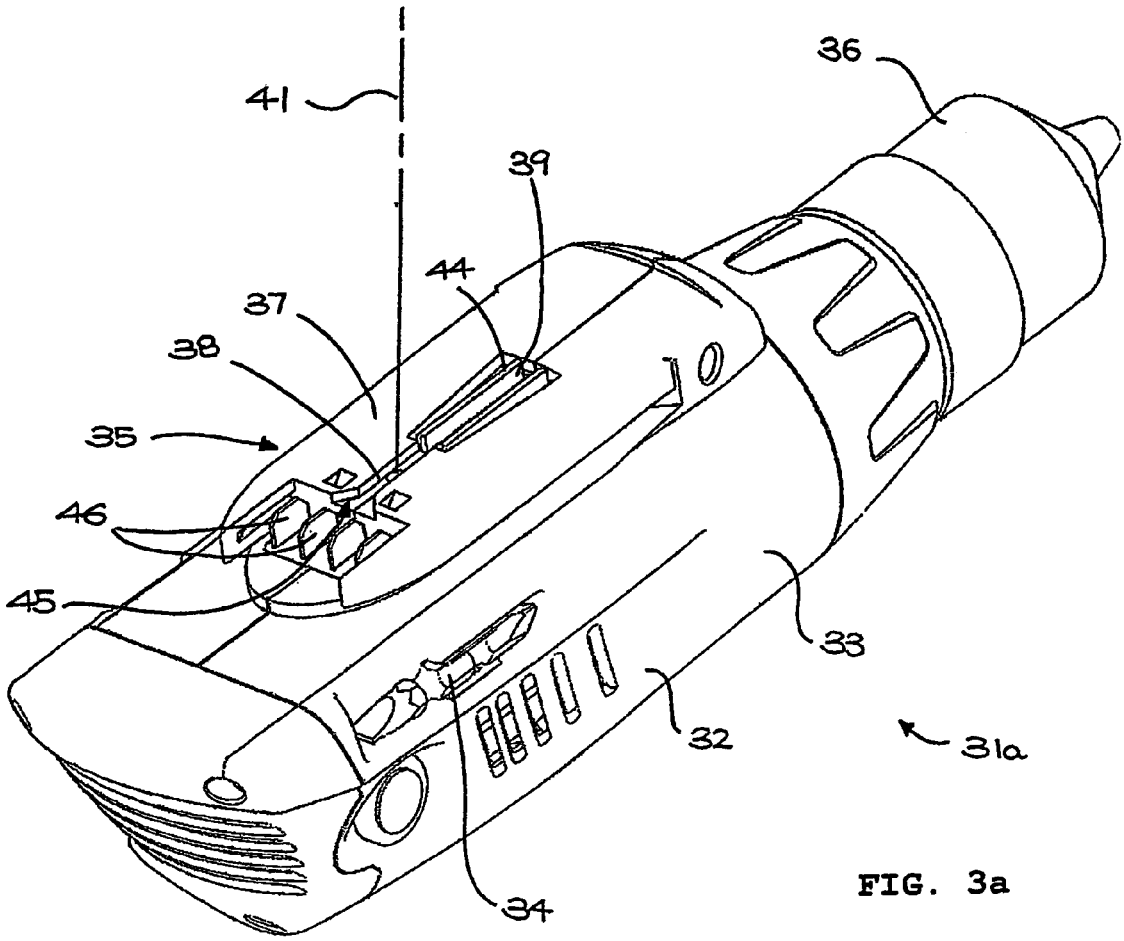
FIG. 3*a* is a pictorial view of a first special-purpose tool of the present invention.

FIG. 3*a* shows a first special-purpose tool 31*a* that includes a casing 32 moulded from a polymeric resin. An electric motor 32 is mounted in the casing for bi-directional rotation of a chuck 36. By appropriate selection of drive bit 34 the special-purpose tool 31*a* can be used for driving screw threaded fasteners.

Figure 3B:
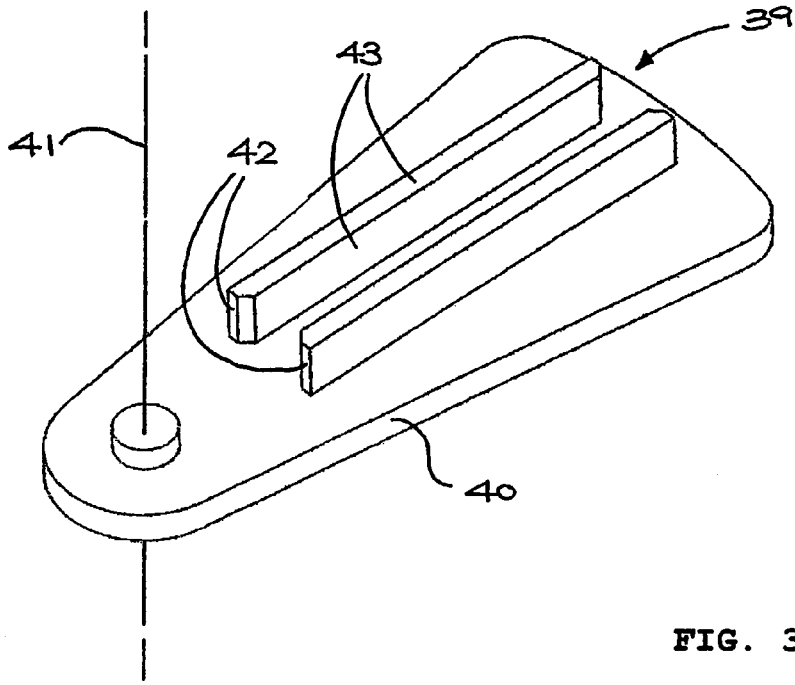
FIG. 3*b* is a pictorial view of a link of the tool of FIG. 3*a;*

A male connector 35*a* is formed on the casing 32 and has an outer substantially planar pilot region 37. Extending longitudinally along the centre of the pilot region 37 is a slot 38 which is illustrated in linear alignment with an elongate channel 39 formed in a link 40. The link 40 (shown separately in FIG. 3*b*) is mounted within the male connector 35*a* to pivot about an axis 41 through a small angle either side of the central position shown. The walls 42 of the channel 39 are received in a hole 44 in the pilot region 37 which has the shape of a ring segment and the outer edges 43 of the channel 39 lie generally at or below the plane of the region 37.

In use, the male connector 35*a* is entered into the recess in the female connector 5, the pilot region 37 being slid across the pilot surface 20. The open end of the slot 38 is tapered outwardly toward its end, allowing the limb 25, irrespective of its initial position, to be funnelled into the slot 38, from which it is then slid into the channel 39 of the link 40. The adjacent nub 27 of the interlock operator 13 is likewise slid through the slot 38 into the channel 39. At the end of its linear travel the contacts 46 on the male connector engage those on the female connector and the latch 28 is actuated, thus completing a secure and stable mechanical and electrical connection. In this position, the axis 41 is generally aligned with the axis 11 and the link 40 connects the interlock operator 13 and the secondary switch 24, such that moving the button 12 to either side of the two armed positions moves the secondary switch 24 to its two respective closed positions. When connected to the fastener driver tool 31*a*, the secondary switch 24 is used to control the direction of rotation of the motor 33.

Figure 4B:
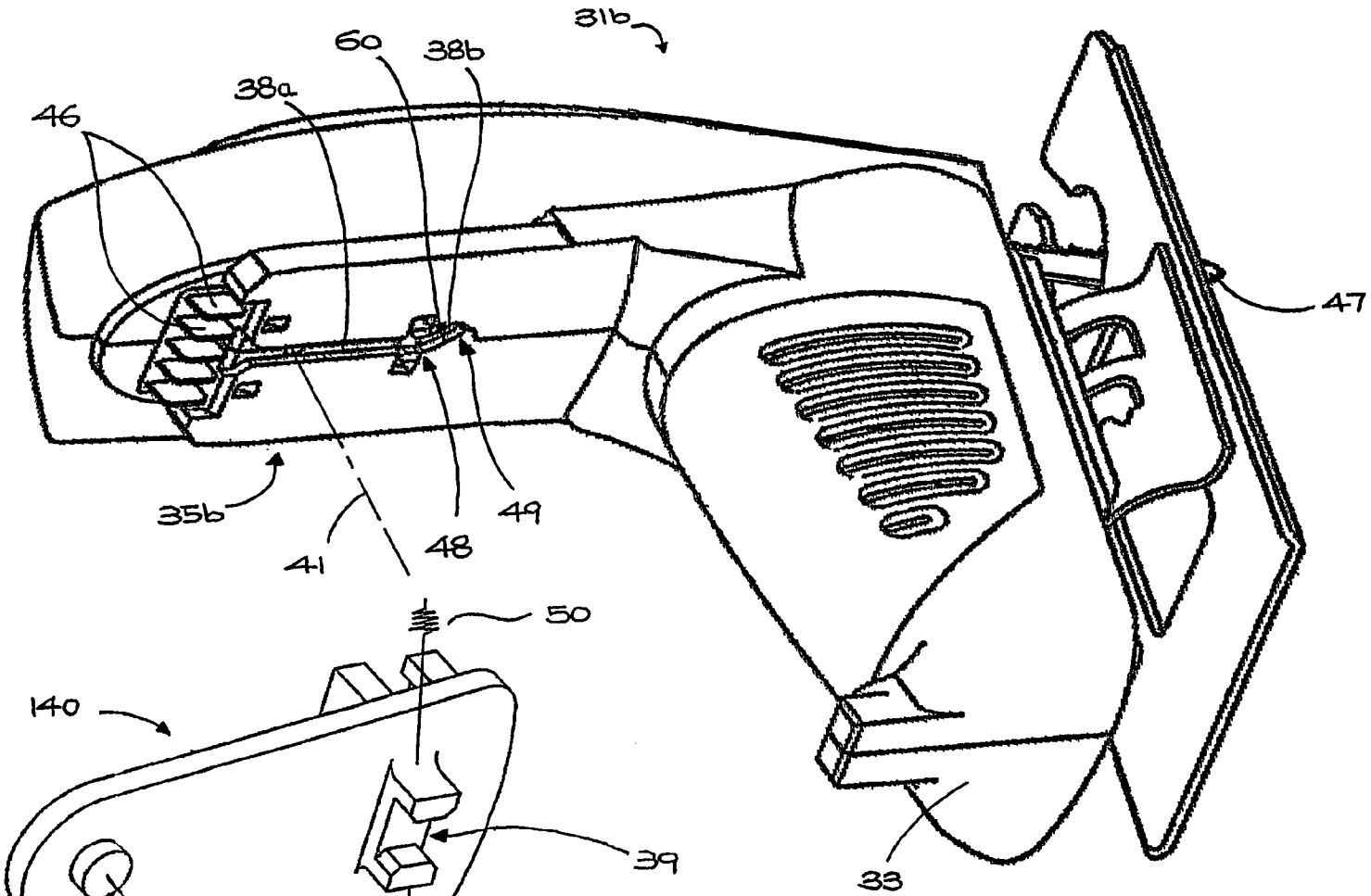
FIG. 4*b* is a pictorial view of a link of the tool of FIG. 4*a*.
Figure 4A:
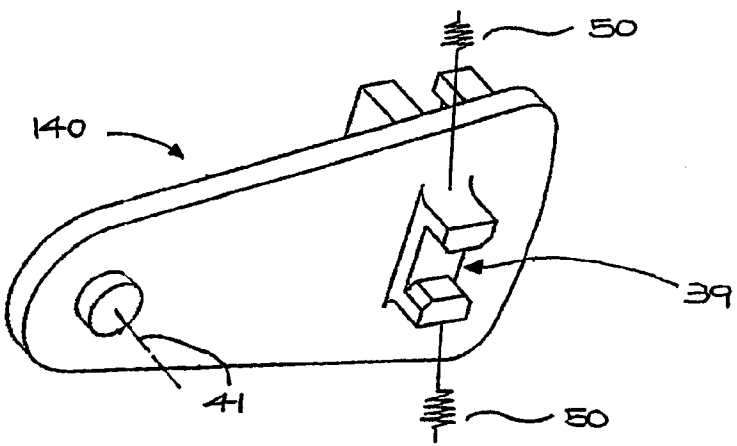
FIG. 4*a* is a pictorial view of a second special-purpose tool of the present invention.

FIG. 4*a* shows a second special-purpose tool 31*b* having a motor 32 driven in one-directional to reciprocate a saw blade 47. The male connector 35*b* is of like construction to connector 35*a*, in as much as it is sized to fit in the same recess, includes contacts 46 and planar pilot region 37. In like manner to the link 40, a pivot member 140 (shown separately in FIG. 4*b*) is mounted within the male connector 35*a* to pivot about an axis 41 through a small angle either side of the central position shown. The slot 38 includes slot mouth portion 38*a*, and slot end portion 38*b* adjacent either side of the channel 39 in the pivot member 140. Slot portion 38*b* extends from a mouth 48 longitudinally aligned with slot portion 38*a*, to a closed end 49 offset therefrom in a transverse direction, and having an inclined engagement face 60. A spring, schematically represented by springs 50 connects the pivot member 140 to bias the channel 39 to the central position shown, where it is longitudinally aligned with slot portion 38*a*.

In use nub 27 is received in channel 39 in the pivot member 140, thereby biasing the bar 9 and button 12 to their central positions, placing the interlock operator 13 in its guard position to which it is biased by the spring 50. Likewise, engaging the male and female connectors 35*b*, 5 slides the limb 58 along the channel portion 38*b* to contact the engagement face 60 before it is received in the end 49 of the channel. The engagement face 60 thereby moves the secondary switch 24 to one of its operating positions. In the specific embodiment shown the secondary switch 24 controls motor direction and so these features of the male connector 35*b* ensure correct directional rotation of the motor 33.

Figure 5:
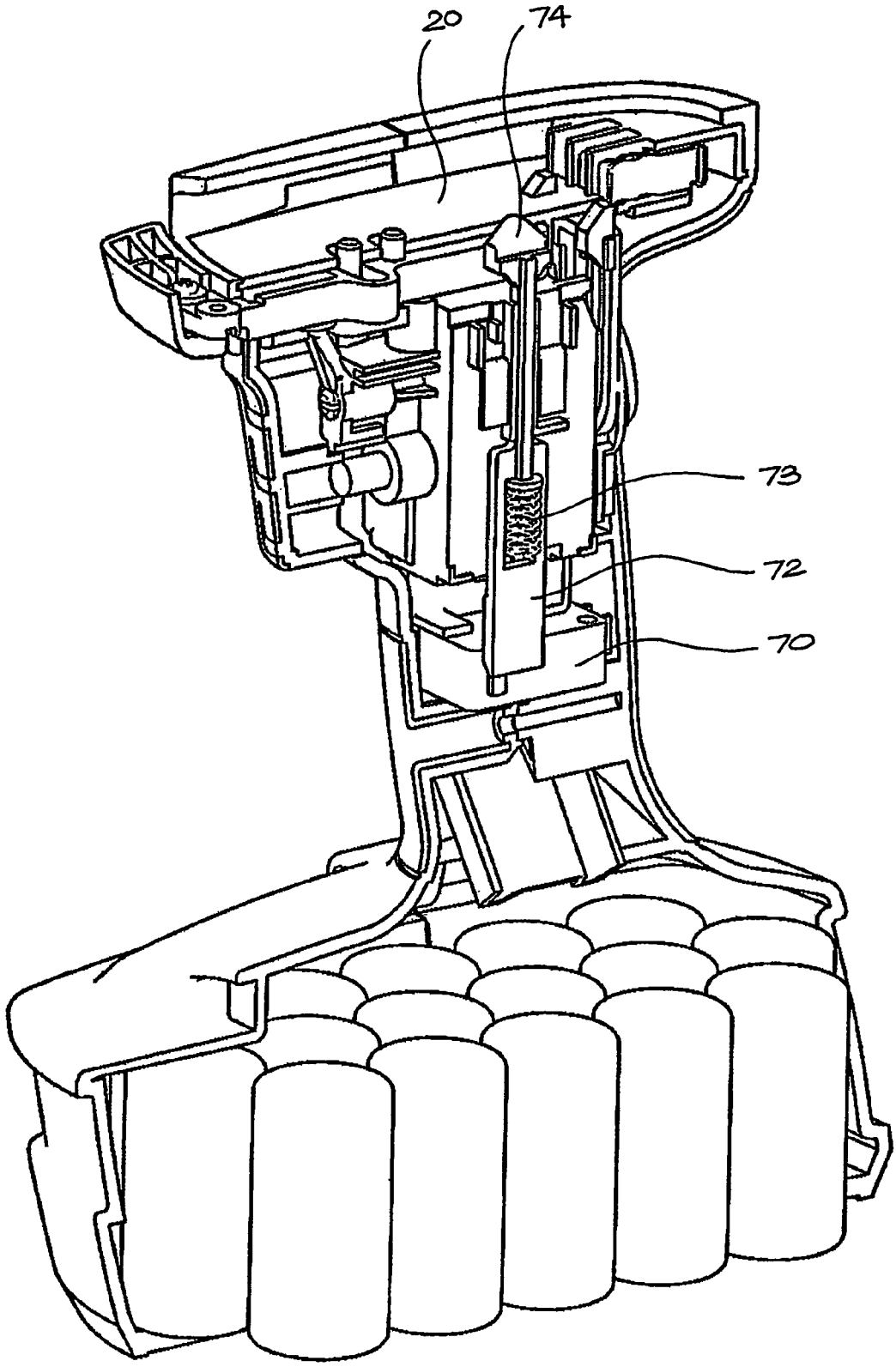
FIG. 5 is a part-sectional pictorial view of the power handle module of FIG. 1.
Figure 6:
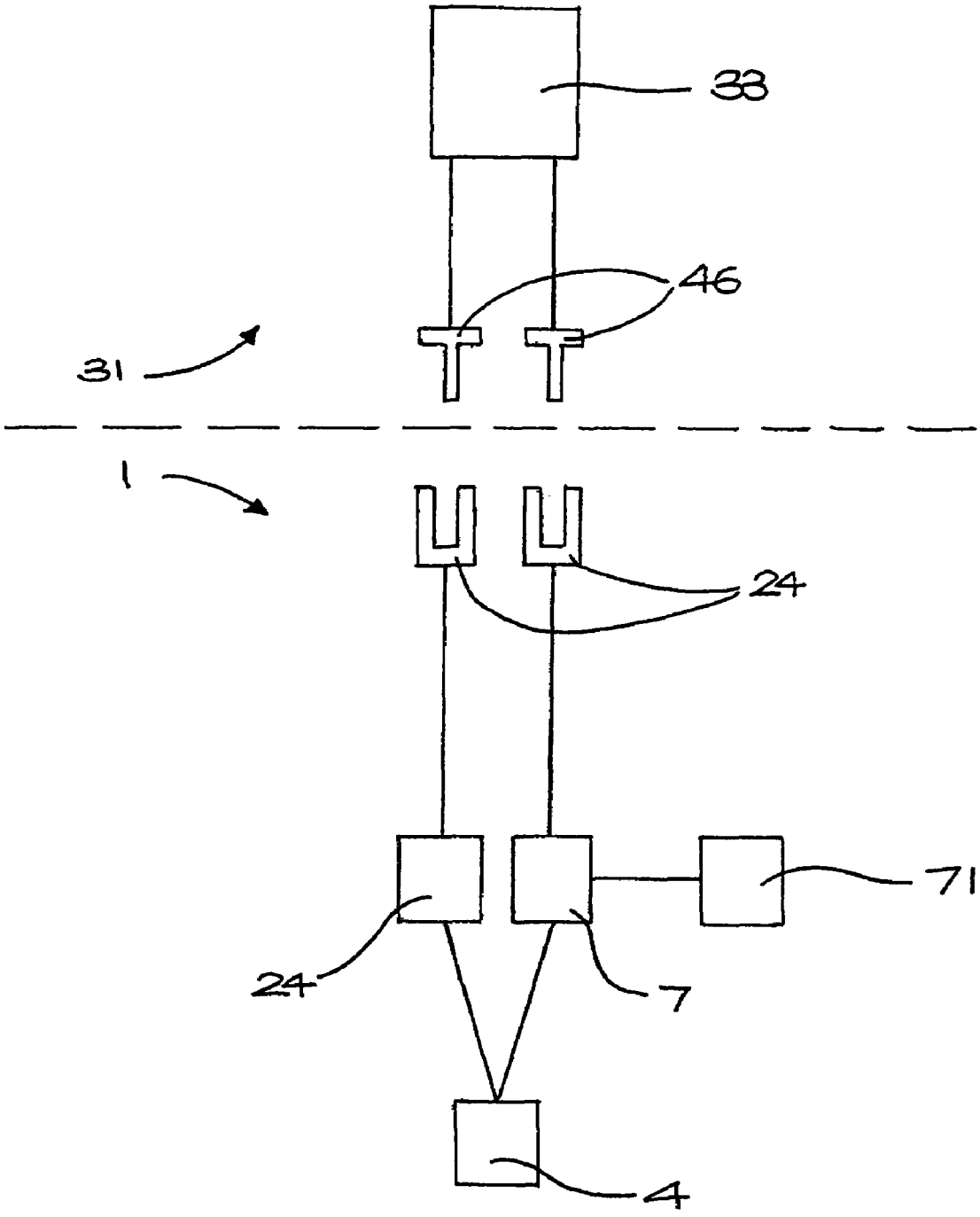
FIG. 6 is a schematic showing the electrical connection between the components of the power handle module.

Referring to FIGS. 5 and 6, the trigger switch 7 includes an electronic controller (not shown) allowing it to operate in a modulating mode (for variable speed control of motor speed, for example) or in an on-off mode (for on-off control of a lamp, for example). The trigger switch 7 is connected to a changeover switch 71 which controls the selection of modulating or on/off modes. The changeover switch 71 is operated by an elongate actuator 72 mounted to slide approximately longitudinally in the handgrip. The tip 74 of the actuator 72 is biased by a spring 73 to project from the pilot surface 20. With the tip 74 in the extended position shown in FIG. 5 (when not engaged with the male connector 35*b* or when received in a recess in the surface of the male connector 35*b*) the changeover switch 71 is closed allowing the trigger to be used for modulating the operation of the attached special-purpose tool. Otherwise the planar pilot region 37 contacts the tip 74 to close the changeover switch 71, thereby allowing the trigger to be used for on-off control of the special-purpose tool.

Aspects of the present invention have been described by way of example only and it should be appreciated that modifications and additions may be made thereto without departing from the scope thereof.

The invention claimed is:

1. A modular electric tool system comprising:

a power handle module including a housing, the housing having an elongate portion providing a hand grip, a trigger switch within the housing and a trigger projecting from the housing for actuation by a user having his hand on the hand grip, the trigger actuating the trigger switch, an interlock operator projecting from the housing for movement between a guard position and first and second armed positions, the interlock operator, in the guard position, resisting movement of the trigger, and the interlock operator, in each of the first and second armed positions, allowing the trigger to actuate the trigger switch, a first connector on the housing, the first connector including a plurality of electrical contacts, a secondary switch disposed within the housing and selectively switchable between respective secondary switch positions, power supply means, and a circuit inside the housing for electrically connecting the first plurality of contacts, the trigger switch, the secondary switch, and the power supply means; and a special-purpose tool including a casing, an electrically powered device inside the casing, a second connector on the casing for selective engagement of and disengagement from the first connector, the second connector including a second plurality of electrical contacts, wherein mechanical connection of the first connector to the second connector mechanically connects the power handle module to the special-purpose tool and electrically connects the first plurality of contacts to the second plurality of contact for supplying electrical power to the electrically powered device from the power supply means, and a link on the casing mechanically joining the secondary switch to the interlock operator upon connection of the first connector to the second connector so that, by moving the interlock operator between the first armed position and the second armed position, the secondary switch is moved between the respective secondary switch positions to supply electrical power to the electrically-powered device.

2. The tool system of claim 1, wherein the electrically powered device in the casing comprises an electric motor, the special-purpose tool includes a chuck drivingly connected to the electric motor, and the interlock operator moves the secondary switch between the respective secondary switch positions to select direction of rotation of the electric motor.

3. The tool system of claim 1, wherein, when the first connector is connected to the second connector, the first and second connectors are joined at an interface, and the interlock operator includes a protruding portion extending through a portion of the interface for engaging the special-purpose tool.

4. The tool system of claim 3, wherein the protruding portion is completely recessed within the housing.

5. The tool system of claim 1, wherein the trigger switch has a modulating mode and an on/off mode, and including a changeover switch connected to the trigger switch for controlling selection of one of the modulating and on/off modes, and actuating means connected to the changeover switch for engaging a feature of the special-purpose tool upon connection of the first connector to the second connector.

6. The tool system of claim 5, wherein, when the first connector is connected to the second connector, the first and second connectors are joined at an interface and the actuating means has a part biased to protrude through a portion of the interface for engaging the feature of the special-purpose tool.

7. A modular electric tool system comprising:

a power handle module including a housing, the housing having an elongate portion providing a hand grip, a trigger switch disposed within the housing and a trigger projecting from the housing for actuation by a user having his hand in place on the hand grip, the trigger actuating the trigger switch, an interlock operator projecting from the housing for movement between a guard position and first and second armed positions, the interlock operator, in the guard position, resisting movement of the trigger, and the interlock operator, in each of the first and second armed positions, allowing the trigger to actuate the trigger switch, a first connector on the housing, the first connector including a plurality of electrical contacts, a secondary switch disposed within the housing and selectively switchable between respective secondary switch positions, power supply means, and a circuit inside the housing for electrically connecting the first plurality of contacts, the trigger switch, the secondary switch, and the power supply means; and a special-purpose tool including a casing, an electrically powered device inside the casing, a second connector on the casing for selective engagement of and disengagement from the first connector, the second connector including a second plurality of electrical contacts, wherein mechanical connection of the first connector to the second connector mechanically connects the power handle module to the special-purpose tool and electrically connects the first plurality of contacts to the second plurality of contact for supplying electrical power to the electrically powered device, and resilient means on the casing for biasing the interlock operator toward the guard position.

8. The tool system of claim 7, wherein the electrically powered device is an electric motor for driving a saw blade, and the special-purpose tool comprises an engagement face for engaging the secondary switch upon connection of the first connector to the second connector moving the secondary switch to one of the secondary switch positions and selecting direction of rotation of the electric motor, the resilient means providing a safety switch.

9. The tool system of claim 8, wherein the electric motor drives one of a reciprocating saw blade and a rotary saw blade.

10. The tool system of claim 8 comprising:

an engagement face engaging the secondary switch upon connection of the first connector to the second connector and moving the secondary switch to one of the secondary switch positions, wherein the first and second connectors comprise complementary female and male connectors respectively located on the housing of the power handle module and on the casing of the special-purpose tool, providing sliding selective interengagement and disengagement, the male connector has a pilot region for engaging a pilot surface on the power handle module, the secondary switch has a limb by which the secondary switch is actuated, the limb protrudes from the pilot surface, the interlock operator includes a nub protruding from the pilot surface, and either the link includes a channel which slidably receives both the limb and the nub upon connection of the male connector to the female connector, or the engagement face is located in a nub-receiving channel in the pilot region for slidably receiving the nub, and the engagement face extends obliquely to an axis of relative sliding movement between the male and female connectors.

11. The tool system of claim 10, wherein the resilient means includes a pivoting member having a pivoting member channel for slidably receiving the limb, and a spring biasing the pivoting member channel into linear alignment with the channel receiving the nub.

12. The tool system of claim 7, wherein, when the first connector is connected to the second connector, the first and second connectors are joined at an interface, and the interlock operator includes a protruding portion extending through a portion of the interface for engaging the special-purpose tool.

13. The tool system of claim 12, wherein the protruding portion is completely recessed within the housing.

14. The tool system of claim 7, wherein the trigger switch has a modulating mode and an on/off mode, and including a changeover switch connected to the trigger switch for controlling selection of one of the modulating and on/off modes, and actuating means connected to the changeover switch for engaging a feature of the special-purpose tool upon connection of the first connector to the second connector.

15. The tool system of claim 14, wherein, when the first connector is connected to the second connector, the first and second connectors are joined at an interface and the actuating means has a part biased to protrude through a portion of the interface for engaging the feature of the special-purpose tool.

16. A power handle module releasably couplable to a special-purpose tool, the special-purpose tool having a casing enclosing an electric motor, the power handle module comprising:

a housing having an elongate portion providing a hand grip;

a first connector disposed on the housing for sliding interengagement with a complementary, second connector, disposed on the casing of the special-purpose tool so that connection of the first connector to the second connector mechanically connects the power handle module to the special-purpose tool, the first connector including a first plurality of electrical contacts for engaging a second plurality of electrical contacts on the special-purpose tool when the power handle module is connected to the special-purpose tool;

a pilot surface recessed in the first connector for selectively engaging a complementary pilot region on the second connector when the power handle module is connected to the special-purpose tool;

a trigger switch disposed within the housing and a trigger, the trigger projecting from the housing for actuation by a user having his hand on the hand grip to actuate the trigger switch;

a secondary switch disposed within the housing for controlling supply of electrical power to at least one of the electrical contacts of the first plurality of electrical contacts;

batteries disposed within the housing;

a circuit inside the housing and electrically connecting the first plurality of contacts, the trigger switch, the secondary switch, and the batteries; and an interlock operator mounted on the housing for movement between a guard position and first and second armed positions, the interlock operator, in the guard position, resisting movement of the trigger, each of the first and second armed positions allowing the trigger to actuate the trigger switch.

17. The power handle module of claim 16, wherein the secondary switch comprises a limb for moving the secondary switch between respective secondary switch positions, and including a nub fixed to the interlock operator, wherein the limb and the nub protrude from the pilot surface.

18. A special-purpose tool releasably couplable to the power handle module of claim 17, the special-purpose tool comprising:

the casing enclosing the electric motor;

one of a saw blade and a drill chuck coupled to the electr1c motor for driving by the electric motor;

the second connector on the casing;

the pilot region; and the second plurality of electrical contacts on the second connector and one of:

a link having a channel which slidably receives both the limb and the nub upon connection of the first connector to the second connector, mechanically joining the secondary switch and the interlock operator so that, by moving the interlock operator between the first and second armed positions, the secondary switch is moved between the respective secondary switch positions, selecting supply of electrical power to the electric motor of the special-purpose tool, and resilient means mounted on the casing and biasing the interlock operator toward the guard position to provide a safety switch.

* * * * *